US006079250A

United States Patent [19]

Scannell et al.

[11] Patent Number: 6,079,250

[45] Date of Patent: Jun. 27, 2000

[54] ADJUSTABLE MECHANICALLY OPERATED HEMMING APPARATUS

[75] Inventors: James D. Scannell, Grosse Pointe Farms, Mich.; Philip V. Wiens, Ontario, Canada

[73] Assignee: Unova IP Corp., Woodland Hills, Calif.

[21] Appl. No.: 09/374,365

[22] Filed: Aug. 13, 1999

[51] Int. Cl.[7] ..... B21D 5/04

[52] U.S. Cl. ..... 72/381; 72/447; 72/452.9; 83/635

[58] Field of Search ..... 72/446, 447, 452.8, 72/452.9, 381; 83/635

[56] References Cited

U.S. PATENT DOCUMENTS 3,147,726 9/1964 Tribe ..... 29/243.58
5,269,167 12/1993 Gerhart ..... 72/452.9

FOREIGN PATENT DOCUMENTS 1445675 6/1965 France ..... 72/304

*Primary Examiner*—David Jones
*Attorney, Agent, or Firm*—Reising, Ethington, Barnes, Kisselle, Learman & McCulloch, P.C.

[57] ABSTRACT

A hemming apparatus has a stand which is axially and rotatably adjustable, a carrier pivotally connected to the stand and a hemming tool adjustably received on a slide assembly which in turn is slidably received on the carrier. The hemming tool can be rotatably adjusted relative to the carrier to properly orient the hemming tool on the slide assembly for engagement with a flange of a sheet metal panel to hem the flange. Further, the stand can be axially and rotatably adjusted and the carrier can be pivotally adjusted relative to the stand to vary the orientation and path of travel of the slide assembly and hence the hemming tool relative to the sheet metal panels. Desirably, this readily adjustable and versatile hemming apparatus can be used to form or hem the flange of substantially any sheet metal panel having contours or corners of substantially any configuration or orientation.

19 Claims, 5 Drawing Sheets

16
7
38
43
43
41
41
40
43
36
43
102
81
77
28
35
14
100
34
83
72
2
87
79
18
104
76
78
74
42
122
118
64
84
26
62
10
22
20
32
120
68
70
66
58
24
80
30
44
7
53
54
56
55
50
60
52
46
48
12

ADJUSTABLE MECHANICALLY OPERATED HEMMING APPARATUS

FIELD OF THE INVENTION

This invention relates generally to the hemming of sheet metal and more particularly, to an adjustable hemming apparatus.

BACKGROUND OF THE INVENTION

It is well known to construct motor vehicle body doors, hoods, fenders, tailgates, trunks and deck lids by stamping an outer sheet metal panel and separately stamping an inner sheet metal reinforcing panel and then joining the two panels together by hemming a flange of the periphery of the outer panel over an adjacent edge of the inner panel to secure the panels together. Desirably, the outer panel is slightly larger than the inner panel to provide a border flange portion along the periphery of the outer panel which preferably has an upstanding lip which can be folded over the peripheral edge of the inner panel to define the hem flange which connects the two panels.

To provide a smooth and fair hem or fold line on contoured portions of a panel or at the corners of the sheet metal panels, the hemming apparatus must engage and hem the flange at a specific angle and along a specific path of travel to evenly and smoothly fold or hem the flange. Notably, the various panels of an automobile have different shapes and sizes with contoured portions or corners which require differently shaped hemming tools and hemming tools moving, on different planes or paths of motion to provide smooth and fair fold lines. Prior hemming devices have utilized a hem tool movable through a fixed path of motion to hem a particular corner of a particular panel. Hence, separate hemming devices must be specifically designed to form a particular portion of a particular panel thereby requiring a plurality of hemming devices to hem the comers or other contoured portions of various sheet metal panels.

SUMMARY OF THE INVENTION

A hemming apparatus has a stand which is axially and rotatably adjustable, a carrier pivotally connected to the stand and a hemming tool adjustably received on a slide assembly which in turn is slidably received on the carrier. The hemming tool can be rotatably adjusted relative to the carrier to properly orient the hemming tool on the slide assembly for engagement with a flange of a sheet metal panel to hem the flange. Further, the stand can be axially and rotatably adjusted and the carrier can be pivotally adjusted relative to the stand to vary the orientation and path of travel of the slide assembly and hence the hemming tool relative to the sheet metal panels. Desirably, this readily adjustable and versatile hemming apparatus can be used to lorm or hem the flange of substantially any sheet metal panel having contours or corners of substantially any configuration or orientation.

The hemming tool may be actuated by a drive cam carried by a press platen which is reciprocated between retracted and advanced positions to engage the drive cam with a follower of the hemming apparatus to advance the slide assembly from its retracted to its advanced position to at least partially form a hem of a sheet metal panel. Desirably, after engaging the follower and driving the hemming tool to its advanced position, the drive cam pivots away from the follower upon return of the platen to its retracted position to permit the hemming tool to return to its retracted position. Still further, a lost motion coupling between the follower and the remainder of the slide assembly permits some relative motion of the follower relative to the remainder of the slide assembly which provides an impact force to the slide assembly to disengage the hemming tool from the sheet metal panels and ensure that the hemming tool releases from the panels and returns to its retracted position for a subsequent hemming stroke.

Objects, features and advantages of this invention include providing a hemming apparatus which may be used to hem a flange of a wide variety of sheet metal panels, provides a significant return force after forming a flange to prevent the hemming tool from becoming jammed or stuck on the sheet metal panels, can be actuated by a linear drive mechanism such as a mechanical press, is readily adjustable to dispose the hemming tool in substantially any orientation and to advance the hemming tool along substantially any linear path of travel, is of relatively simple design and economical manufacture and assembly, is reliable, durable and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
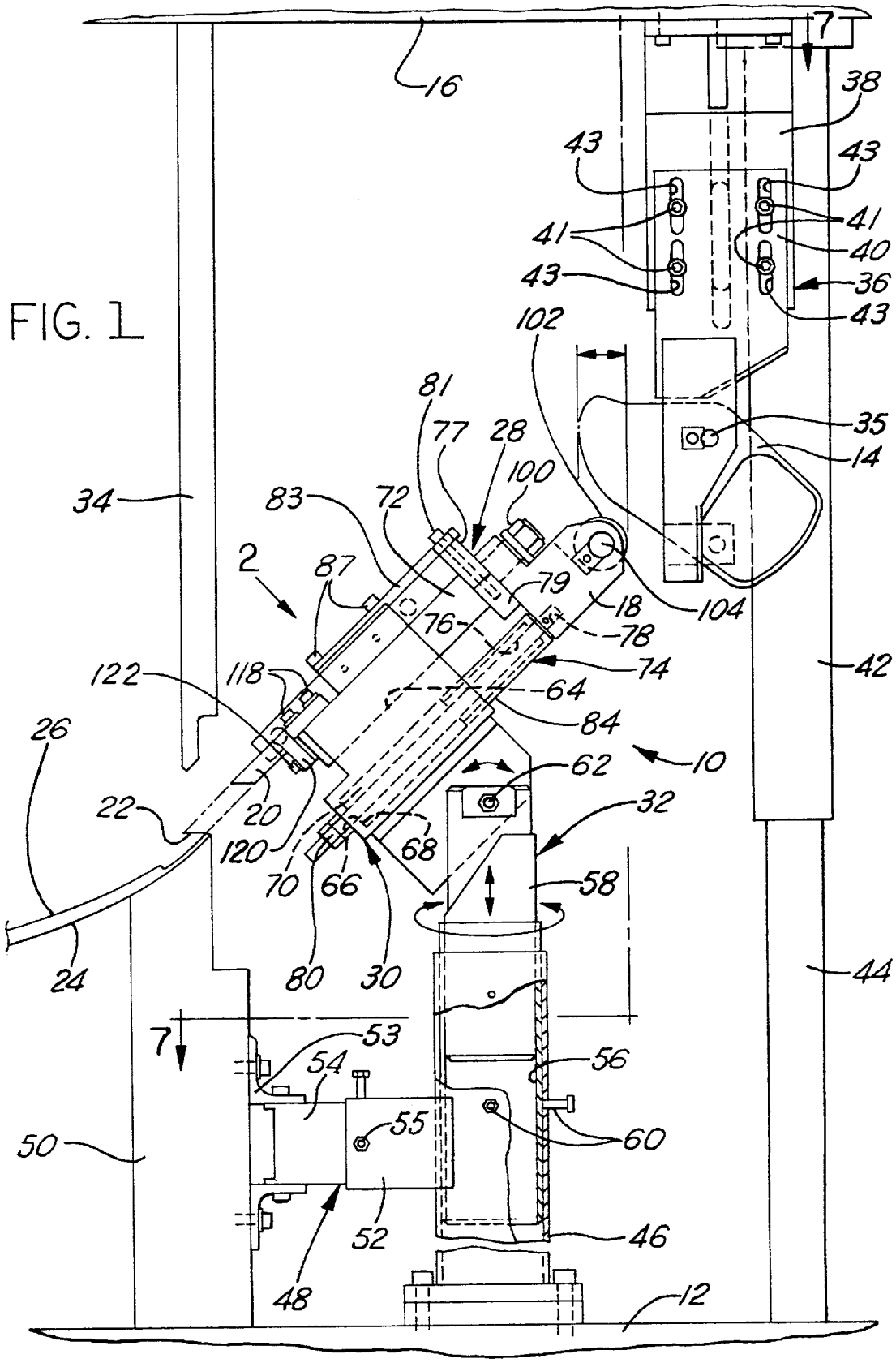
FIG. 1 is a diagrammatic view with parts broken away and in section of a hemming apparatus embodying the present invention.

Referring in more detail to the drawings, FIG. 1 illustrates an adjustable hemming apparatus 10 carried on a lower platen 12 of a press and actuated by a drive cam 14 carried by an upper platen 16 of the press. The upper platen 16 and drive cam 14 are reciprocated between retracted and advanced positions to cause the drive cam 14 to selectively engage a follower 18 of the hemming apparatus 10 to advance a hemming tool 20 to bend or hem a flange 22 of an outer sheet metal panel 24 onto an inner sheet metal panel 26 to connect the panels 24, 26 together. The hemming tool 20 is fixed to and part of a slide assembly 28 which is slidably received on a carrier 30 which in turn is pivotally connected to a stand 32 which is both rotatably and telescopically adjustable to vary the orientation and the path of travel of the hemming tool 20 relative to the sheet metal panels 24, 26. The wide range of adjustment of the hemming apparatus 10 enables the hemming tool 20 to be positioned in substantially any orientation and moved through substantially any linear path relative to the sheet metal panels 24, 26 to provide a smooth and fair fold line of the flange 22 of the outer panel 24 over the inner panel 26 along even contoured sections or corners of the sheet metal panels. Preferably, the hemming tool 20 carried by the apparatus 10 prehems or partially forms the hem 22 by bending the flange 22 to an acute included angle of between about 30° and 60° and a final hemming tool 34 carried by the upper platen 16 is designed to engage the flange 22 after it is formed by the prehem tool 20 to complete the hemming of the flange 22 onto the inner panel 26.

The upper platen 16 of the press is preferably mechanically driven through a press stroke (from a retracted position to an advanced position) and a return stroke (from the advanced position to the retracted position). The drive cam 14 is pivotally mounted by a pin 35 on a bracket 36 fixed to the upper platen 16. The bracket 36 preferably has a first section 38 fixed to the upper platen 16 and a second section 40 fixed to the first section 38 by cap screws 41 which are received in slots 43 to permit slidably adjusting the second section 40 relative to the first section 38 to adjust the position of the drive cam 14 relative to the follower 18. A tubular shaft 42 fixed to the upper platen 16 telescopically receives an upright 44 extending from the lower platen 12 to guide the upper platen 16 as it reciprocates. A final hemming tool 34 is preferably fixed to the upper platen 16 and is constructed to bear on and complete the hemming of the flange 22 of the outer panel 24 onto the inner panel 26 when the upper platen 16 is moved to its filly advanced position.

The stand 32 of the hemming apparatus 10 has an upright portion 46 fixed to the lower platen 12 and a lateral arm 48 fixed to the upright portion 46 and a fixture 50 on which the sheet metal panels 24, 26 are received. To permit lateral adjustment of the stand 32 relative to the fixture 50 and hence, of the hemming tool 20 relative to the sheet metal panels 24, 26, the lateral arm 48 has a tubular portion 52 extending laterally from the upright 46 and telescopically receiving a second portion 54 releasably secured therein with set screws 55 and pivotally attached to a bracket 53 attached to the fixture 50. To vary the height of the hemming tool 20 relative to the sheet metal panels 24, 26, the upright portion 46 of the stand preferably has two or more slidably telescoped tubular portions 56, 58 which may be slidably adjusted as desired and held in place by various set screws 60. Preferably, at least one of the telescoped portions 56, 58 of the upright is also rotatable relative to the other portions to permit adjustment of the angular orientation of the carrier 30, and hence the hemming tool 20 relative to the sheet metal panels 24. 26. This rotational movement of the stand 32 must be limited to avoid moving the follower 18 out of alignment with the drive cam 14. Otherwise, the drive cam 14 must be rotatable and/or movable on the upper platen to ensure that it will engage and drive the follower 18.

The carrier 30 of the hemming apparatus 10 is pivotally connected to an upper end of the upright 46 by a pin 62. The carrier 30 has an elongate recess 64, a through bore 66 and a counterbore 68 defining a cavity 70 to slidably receive, guide and carry the slide assembly 28. The recess 64 has a lower portion 71 which is generally semi-circular in cross-section and an upper portion 73 open to the exterior of the carrier 30. Pivotal movement of the carrier 30 relative to the stand 32 causes a corresponding movement of the slide assembly 28 to change the orientation of the hemming tool 20 relative to the sheet metal panels 24, 26.

Figure 3:
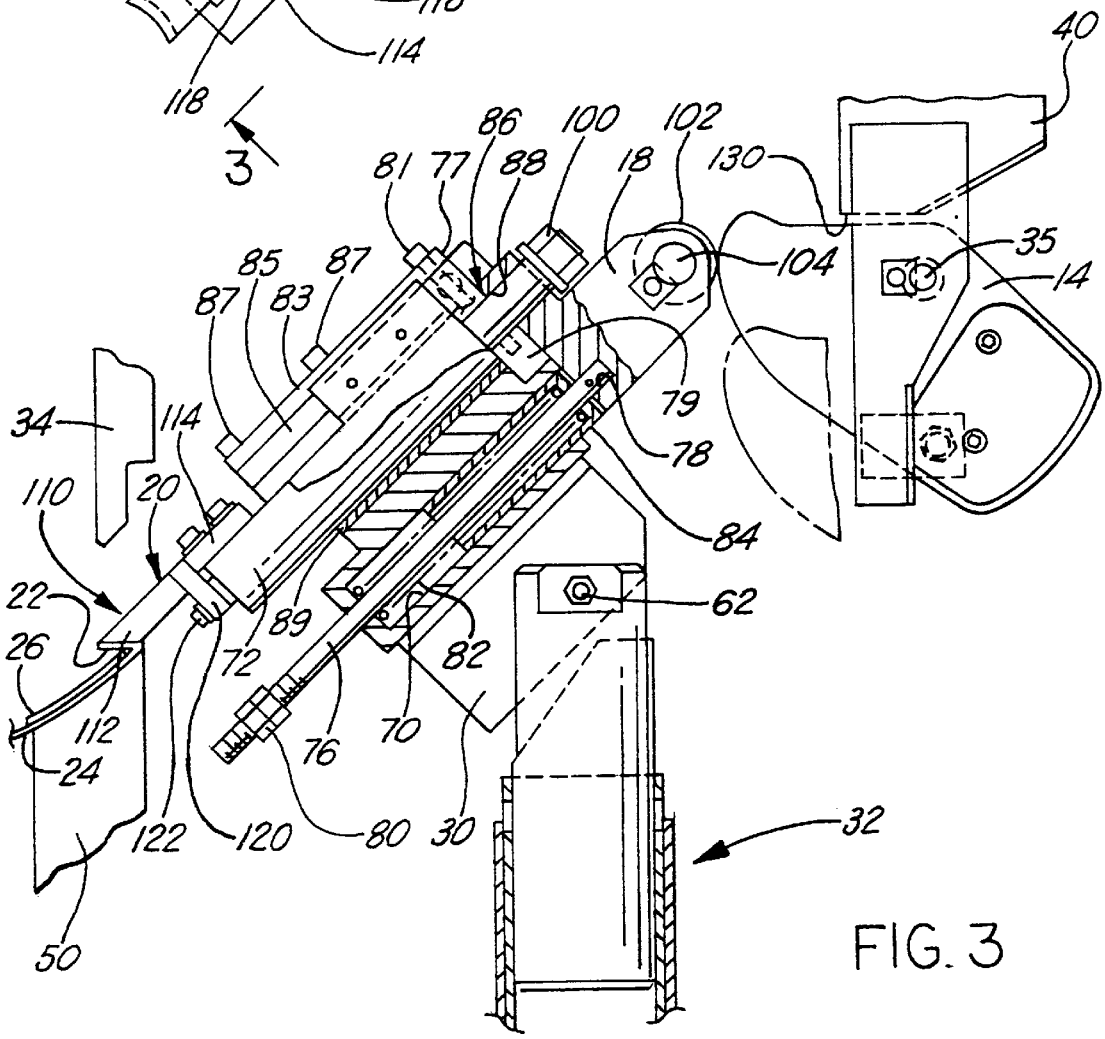
FIG. 3 is a side view of the hemming apparatus viewed in the direction of the arrows 3 of FIG. 2 with parts broken away and in section illustrating the hemming tool in its advanced position.

As shown in FIG. 3, the slide assembly 28 comprises the follower 18, a rotatable adjustment shaft 72, a guide assembly 75 for the adjustment shaft 72, the hemming tool 20 and a return assembly 74. The return assembly 74 has a rod 76 fixed at one end in a cavity 78 of the follower 18 with jamb nuts 80 on its other end to permit adjustment of the effective axial length of the rod 76 to limit movement of the follower away from the carrier 30. A spring 82 (FIG. 3) disposed in the cavity 70 of the carrier 30 bears at one end on the carrier 30 and at its other end on a sleeve 84 slidably received in the cavity 70 and on the shaft 76 and engageable with the follower 18. The rotatable adjustment shaft 72 is slidably received in the lower portion 71 of the recess 64 and extends through a clamp 86 and a bore 88 in the follower 18. To reduce friction between the adjustment shaft 72 and the carrier 30, a bearing 89 (FIG. 3) is preferably disposed around the adjustment shaft 72 in recess 64.

Figure 6:
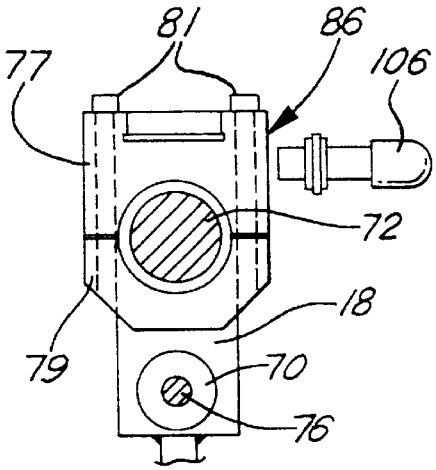
FIG. 6 is a sectional view taken along line 6—6 of FIG. 4.
Figure 7:
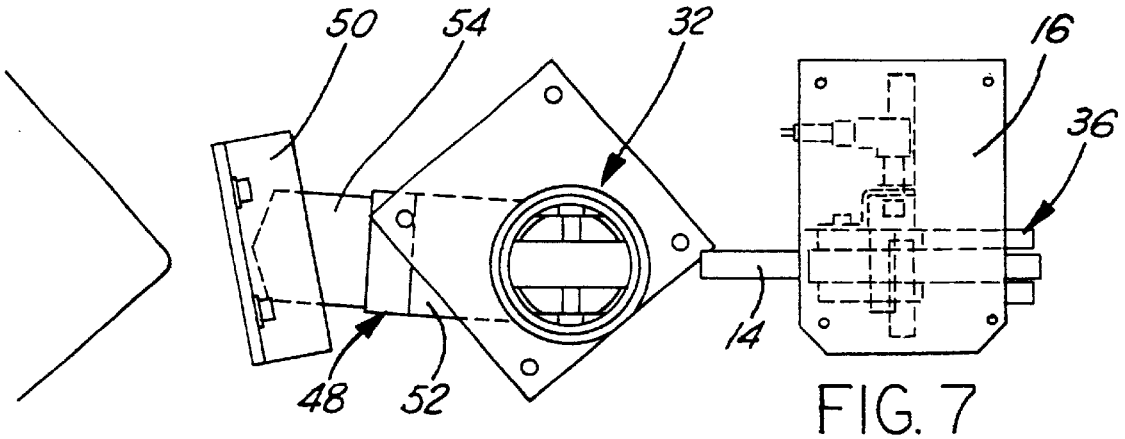
FIG. 7 is a sectional view taken along line 7—7 of FIG. 1.
Figure 8:
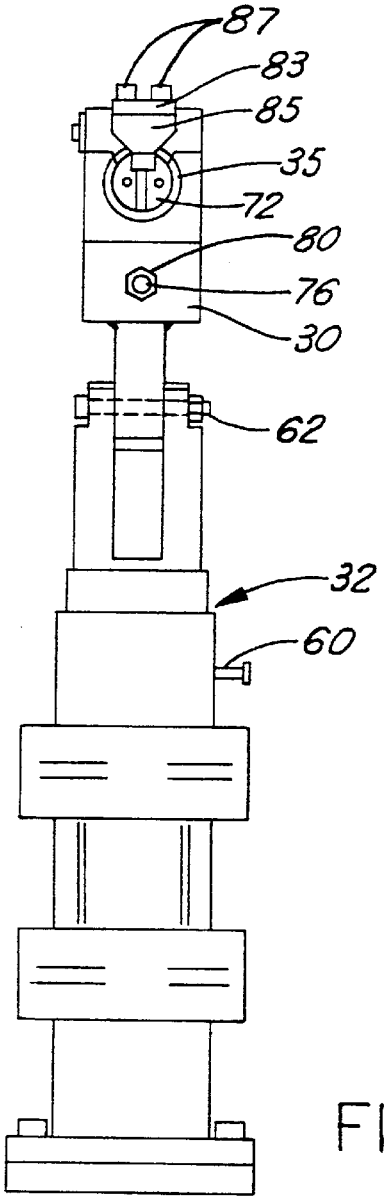
FIG. 8 is a side view of the hemming apparatus.
Figure 9:
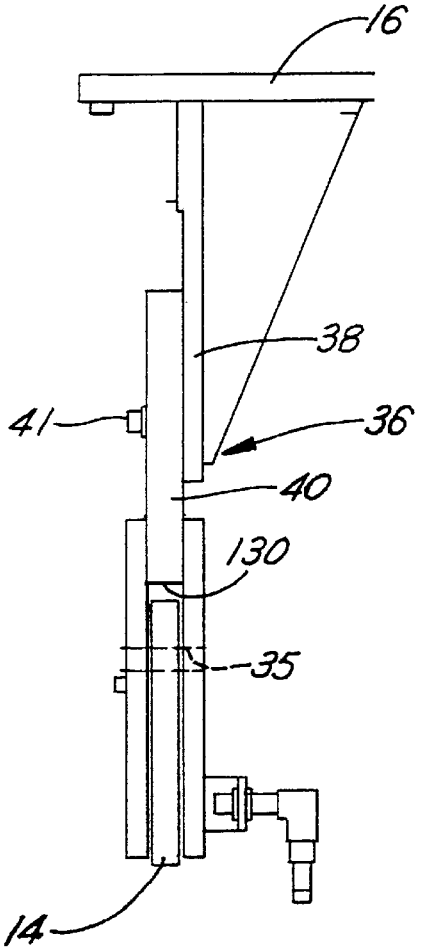
FIG. 9 is a side view of the drive cam pivotally carried by the platen.
Figure 10:
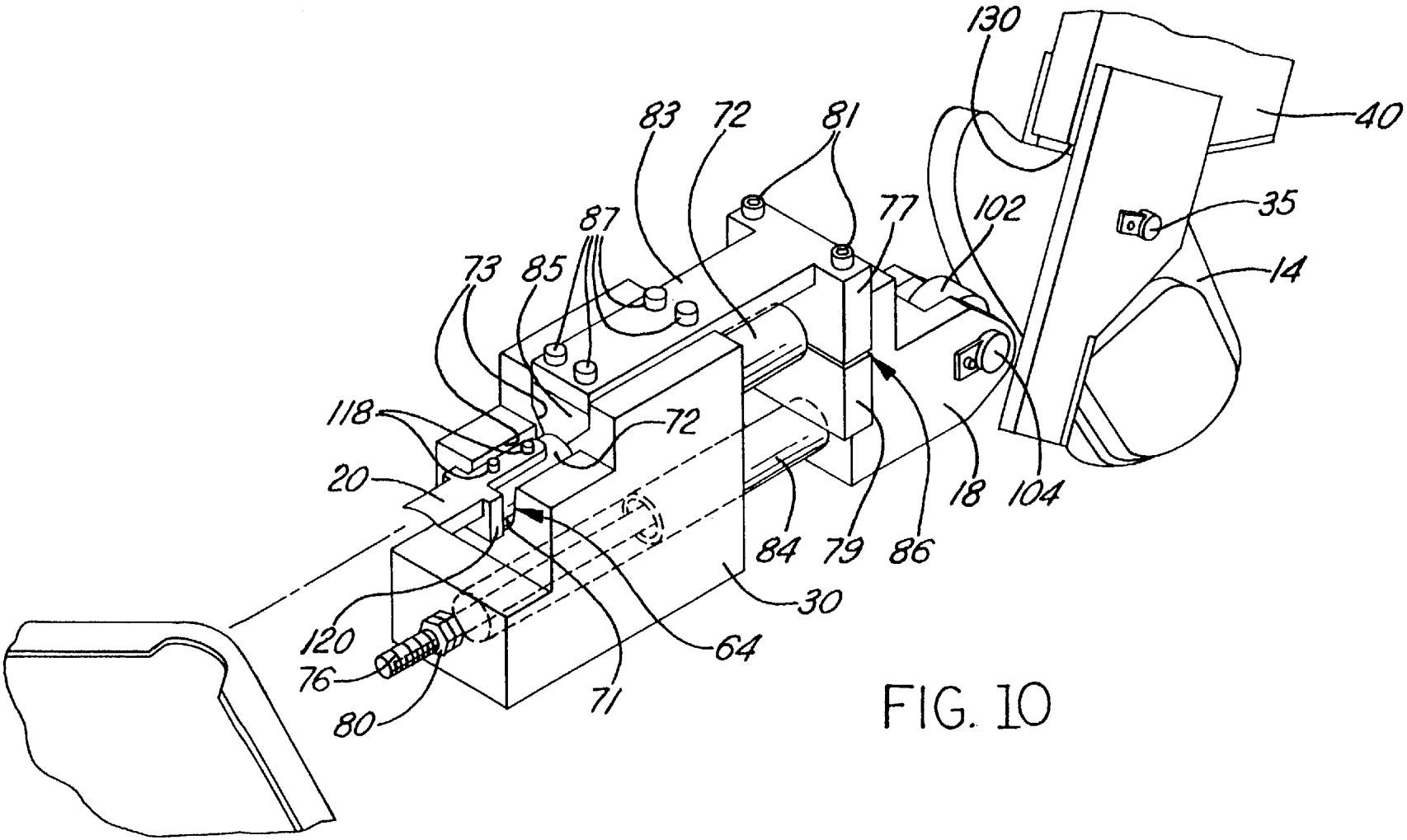
FIG. 10 is a fragmentary perspective view of the hemming apparatus.

As shown in FIG. 6, the clamp 86 has upper and lower plates 77, 79 having generally opposed semi-circular recesses through which the adjustment shaft 72 extends. After rotating the adjustment shaft to its desired angular orientation, cap screws 81 extending through the upper plate 77 and threaded into the lower plate 79 may be tightened to cause the plates 77, 79 to bear on and clamp or hold the adjustment shaft in its desired orientation.

An elongate plate 83 preferably integral with the upper plate 77 is connected to a main guide 85 by cap screws 87 with both the plate 83 and main guide 85 constructed to be closely received in the upper portion 73 of the recess 64 to prevent rotation of and permit only sliding movement of the adjustment shaft 72 relative to the carrier 30.

Figure 2:
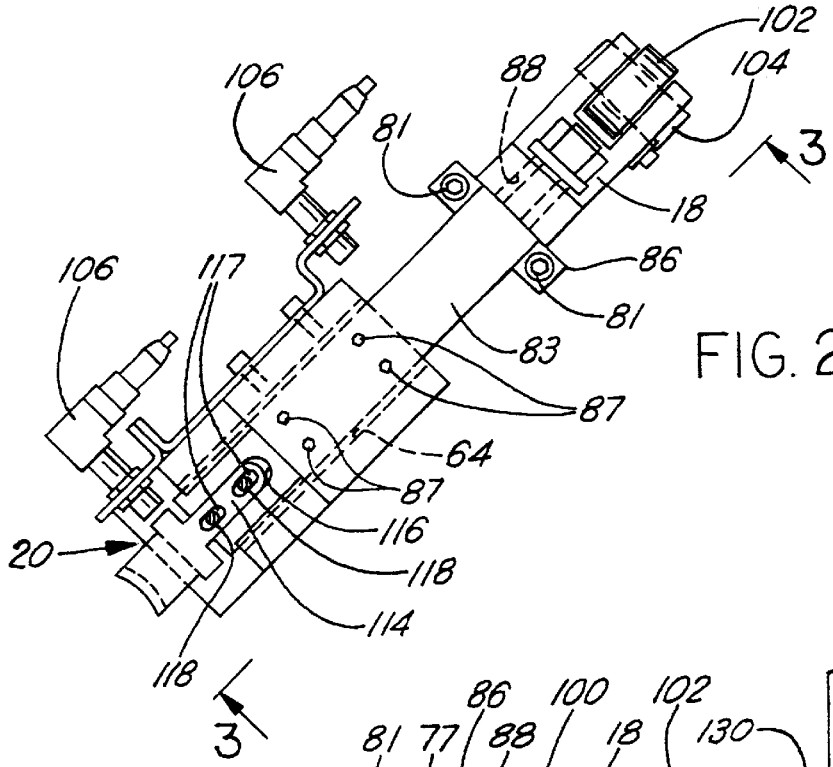
FIG. 2 is a top view of the hemming apparatus viewed in the direction of the arrow 2 of FIG. 1.

To provide a lost motion coupling between them, the follower 18 is slidably received on a reduced diameter shank of the adjustment shaft 72 for movement relative to the adjustment shaft 72 between a shoulder and a nut 100 on the adjustment shaft 72 and the clamp 86. The rod 76 received in the cavity 78 of the follower 18 prevents rotational movement of the follower 18 on the adjustment shaft 72 to maintain the follower 18 aligned with the drive cam 14. The follower 18 preferably has a roller head 102 journalled on a shaft 104 fixed to the follower 18 and constructed to be engaged by the drive cam 14 to reduce friction between the drive cam 14 and follower 18. As shown in FIG. 2, one or more sensors 106 may be attached to the slide assembly 28 or carrier 30 to provide signals corresponding to various positions or movements of the slide assembly 28 along its path of travel.

Figure 4:
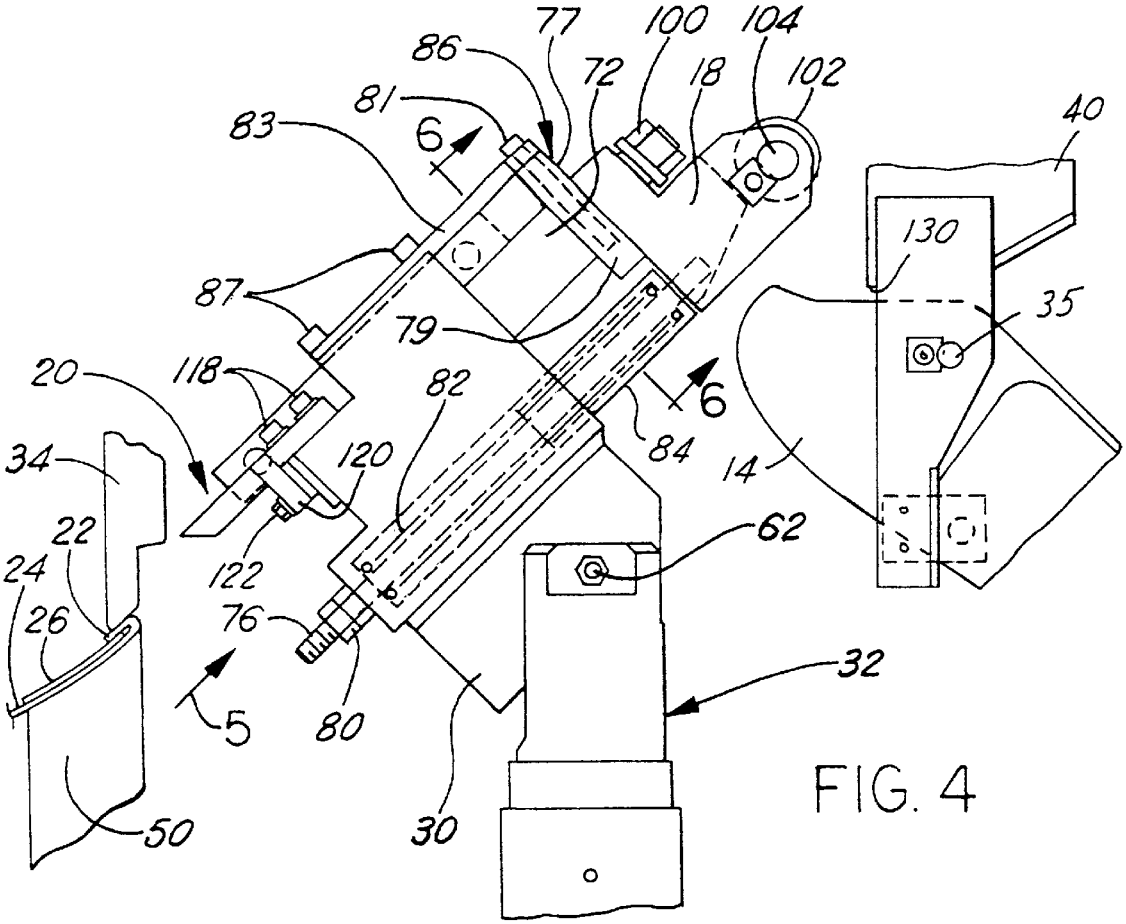
FIG. 4 is a side view of the hemming apparatus as in FIG. 3 illustrating the hemming tool in its retracted position after a hemming stroke.
Figure 5:
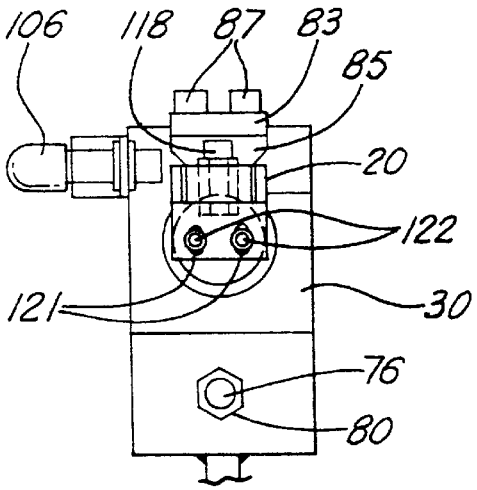
FIG. 5 is an end view of the hemming apparatus taken in the direction of arrow 5 of FIG. 4.

The hemming tool 20 is fixed to one end of the rotary adjustment shaft 72 for co-rotation with the adjustment shaft 72 to permit adjustment of the orientation of the hemming tool 20 relative to the sheet metal panels 24, 26. The hemming tool 20 has a working end 110 constructed to engage the flange 22 and contoured as desired for a particular application. As shown in FIGS. 1, 3 and 4, the hemming tool 20 may have an inclined forming face 112 constructed to engage the flange 22 of the outer sheet metal panel 24 and bend it from an initial approximately 90° to 110° or more degrees to a prehemmed acute included angle of between about 30 and 60 degrees. As shown in FIG. 2, the working end 110 of the hemming tool 20 may be generally concave when used to hem a flange at a comer of a sheet metal panel. A mounting finger 114 of the hemming tool 20 is constructed to be slidably received in a slot 116 formed in the carrier 30. The tool is releasably secured to the shaft 72 by cap screws 118 extending through a pair of elongated slots 117 formed in the finger 114. The cap screws 118 may be loosened or removed to permit slidable adjustment of the hemming tool 20 relative to the carrier 30 and thereafter tightened to hold the hemming tool 20 in its desired location. To provide increased support for the hemming tool 20, it may have a depending arm 120 with a pair of slots 121 (FIG. 5) each of which receives a cap screw 122 extending through the arm 120 and one or more shims 124 and threaded into a blind bore in the adjustment shaft 72. The slots 121 permit the hemming tool 20 to be tilted or inclined relative to the adjustment shaft 72.

Operation

To hem a flange 22 of an outer sheet metal panel 24 onto an inner sheet metal panel 26 the prehemming tool 20 must be properly oriented relative to the panels 24, 26 and moved through a specific linear path of travel to provide a smooth and fair hem. From one panel configuration to the next, the orientation and path of travel of the hemming tool 20 may need to be significantly different. In any event, when the sheet metal panels 24, 26 are received on the fixture 50 the hemming apparatus 10 must be adjusted to provide the linear path of travel of the tool relative to the panels to properly prehem the flange 22. The orientation and the path of travel of the hemming tool 20 may be adjusted by slidably adjusting the hemming tool 20 relative to the adjustment shaft 72, rotating the rotatable adjustment shaft 72, raising or lowering the stand 32, laterally moving the stand 32 relative to the fixture 50, and/or pivotally moving the carrier 30 about its pin 62 as desired or needed for a particular application. The final hemming tool 34 must also be properly oriented on the upper platen 16 to properly hem the flange.

When the hemming apparatus 10 is properly adjusted, the upper platen 16 may be advanced through its press stroke to engage the drive cam 14 with the roller head 102 of the follower 18 to displace the follower 18, adjustment shaft 72 and hemming tool 20 relative to the carrier 30 arid towards the sheet metal panels 24, 26. As shown in FIG. 3, when fully advanced by the drive cam 14, the hemming tool 20 engages the flange 72 of the outer sheet metal panel 24 and forms or bends it to an acute included angle relative to the inner sheet metal panel 26 of between about 30 and 60 degrees to prehem the flange 22. As shown in FIG. 4, further advancement of the upper platen 16 will move the drive cam 14 past the follower 18 to permit the follower 18, adjustment shaft 72 and hemming tool 20 to return to their retracted position under control of the return assembly 74.

The spring 82 provides the force to return the hemming tool 20, adjustment shaft 72 and follower 18 to their retracted positions. To ensure that the hemming tool 20 is returned to its retracted position and does not become jammed or stuck on the sheet metal panels 24, 26, the spring 82 acts on the follower 18 through the sleeve 84 to initially displace the follower 18 relative to the adjustment shaft 72 and thereby create some momentum of the follower to provide an impact force when the follower 18 engages or strikes the head or nut 100 on the adjustment shaft 72 to begin the movement of the adjustment shaft 72 and hemming tool 20 to their retracted position.

With the hemming tool 20 removed from the sheet metal panels 24, 26, further displacement of the upper platen 16 will move the final hemming tool 34 into engagement with the flange 22 to complete the hem as shown in FIG. 4. After the hem is completely formed, the upper platen 16 is returned to its retracted position so that the sheet metal panels 24, 26 can be removed from the fixture 50 and subsequent pair of panels to be hemmed may be placed on the fixture 50. During the return stroke, the drive cam 14 will engage the roller head 102 and thereby cause the drive cam 14 to pivot about its pin 35 generally counterclockwise as viewed in FIG. 4 until the drive cam 14 clears the roller head 102 and is returned to its retracted position with the upper platen 16 as shown in FIG. 1. Notably, the drive cam 14 is mounted such that gravity acting thereon orients it in a position, such as shown in FIG. 1, for engagement with the roller head 102 upon advancement of the upper platen 16. The drive cam 14 engages a stop surface 130 which limits its rotation away from the roller head 102 upon engagement therewith.

Thus, the hemming apparatus 10 according to the present invention is highly and readily adjustable to provide substantially any orientation of the hemming tool 20 relative to the sheet metal panels 24, 26 and to permit the hemming tool 20 to be advanced through substantially any linear work path as desired for a particular application. This wide range of adjustment permits the hemming apparatus 10 to be used with a plurality of sheet metal panels to hem various contoured portions or corners of different configurations of the panels and eliminates the need for separate hemming devices for different panels or for different portions or corners of a panel. Still further, the hemming apparatus 10 may be mechanically driven and is mechanically operated to eliminate the need for any hydraulic or pneumatic cylinders which are costly, have pumps, seals and other parts prone to failure and are difficult and costly to maintain in use.

What is claimed is:

1. A hemming apparatus, comprising:

a stand having a first end constructed to be carried on a base and a second end spaced from the first end with the stand being adjustable to vary the distance between its first and second ends;

a carrier pivotally connected to the stand;

an adjustment shaft slidably carried by the carrier for linear reciprocation between retracted and advanced positions and rotatably adjustable relative to the carrier; and a hemming tool releasably carried by the adjustment shaft whereby when the adjustment shaft is in its retracted position the hemming tool is spaced from a flange to be hemmed and when the adjustment shaft is in its advanced position the hemming tool engages the flange to be hemmed and the orientation of the adjustment shaft relative to the carrier can be adjusted to properly orient the hemming tool relative to the flange to be hemmed and the distance between the first and second ends of the stand may be adjusted and the carrier can be pivoted relative to the stand to provide a desired linear path of travel of the adjustment shaft and hemming tool relative to the flange to be hemmed.

2. The hemming apparatus of claim 1 wherein the hemming tool can be slidably moved relative to the adjustment shaft.

3. The hemming apparatus of claim 1 which also comprises a spring carried by the carrier and yieldably biasing the adjustment shaft toward its retracted position.

4. The hemming apparatus of claim 1 which also comprises a follower operably connected to the adjustment shaft and constructed to be displaced by an actuator to move the adjustment shaft from its retracted position to its advanced position.

5. The hemming apparatus of claim 4 wherein the follower is slidably received on the adjustment shaft to permit a limited amount of relative movement between the follower and adjustment shaft.

6. The hemming apparatus of claim 5 which also comprises a spring carried by the carrier and bearing at one end on the follower to yieldably bias the follower and thereby yieldably bias the adjustment shaft to its retracted position.

7. The hemming apparatus of claim 6 wherein after the adjustment shaft and hemming tool have been moved to their advanced position and the actuating force which moved them there is no longer applied, the spring acts on the follower to initially displace the follower relative to the adjustment shaft until the follower engages a stop surface of the adjustment shaft to provide an impact force to the adjustment shaft to facilitate returning the adjustment shaft to its retracted position.

8. The hemming apparatus of claim 1 wherein the stand comprises a plurality of telescopically connected tubes which may be moved axially relative to one another to vary the distance between the first end and the second end of the stand.

9. The hemming apparatus of claim 8 wherein at least one of the tubes is rotatable relative to the other tubes to permit angular adjustment of the carrier, adjustment shaft and hemming tool relative to an axis of the tubes.

10. The hemming apparatus of claim 1 wherein the stand is constructed to be releasably attached to a base to permit the location of the stand to be varied relative to said base.

11. The hemming apparatus of claim 4 wherein the follower has a shaft and a roller head journalled for rotation on the shaft with the roller head constructed to be engaged by a drive cam to move the adjustment shaft and hemming tool to their advanced position.

12. The hemming apparatus of claim 4 which also comprises a press having a lower platen on which the stand is received and an upper platen driven for linear reciprocation relative to the lower platen between retracted and advanced positions and a drive cam carried by the upper platen for co-movement therewith and being constructed to bear on and displace the follower during at least a portion of the movement of the upper platen from its retracted to its extended position.

13. The hemming apparatus of claim 12 wherein the drive cam is pivotally carried by the upper platen and is constructed so that it is positioned to engage the follower as the upper platen moves from its retracted to its advanced position and to pivot when the upper platen is moved from its advanced position to its retracted position to permit the drive cam to clear and pass the follower.

14. The hemming apparatus of claim 13 which also comprises a second hemming tool carried by the upper platen for movement from a first position spaced from a flange to be hemmed to a second position bearing on said flange.

15. The hemming apparatus of claim 14 wherein the hemming tool carried by the adjustment shaft is constructed to pre-hem a flange of a panel to dispose the flange at an angle of between 30 and 60 degrees relative to the panel and the second hemming tool is constructed to complete the hem of the flange onto the panel.

16. The hemming apparatus of claim 1 wherein the carrier has an elongate recess in which the adjustment shaft is slidably and rotatably received and after rotatably adjusting the adjustment shaft, a clamp is fixed to the adjustment shaft and a plate operably connected to the clamp is slidably received in the recess to prevent further rotary movement of the adjustment shaft relative to the carrier.

17. The hemming apparatus of claim 5 which also comprises a clamp fixed to the adjustment shaft and a nut received on an end of the adjustment shaft with the follower slidably received on the adjustment shaft between the clamp and nut.

18. The hemming apparatus of claim 16 wherein the clamp has an upper plate and a lower plate connected together by cap screws to bear on and clamp the adjustment shaft received between the upper plate and lower plate when the cap screws are tightened.

19. The hemming apparatus of claim 16 which also comprises a main guide operably connected to said plate operably connected to the clamp and constructed to be closely slidably received in the recess of the carrier to guide the adjustment shaft for linear reciprocation.

* * * * *